United States Patent [19]

Spiritini et al.

[11] 4,407,604

[45] Oct. 4, 1983

[54] METHOD AND DEVICE FOR LAYING ROADMAKING MATERIAL IN A ROADWAY

[75] Inventors: Massimo Spiritini, Passau, Fed. Rep. of Germany; Christoph Stiehler, Dr.-Hellge-Strasse 19, 8390 Passau, Fed. Rep. of Germany

[73] Assignee: Christoph Stiehler, Hamburg, Fed. Rep. of Germany

[21] Appl. No.: 285,795

[22] Filed: Jul. 22, 1981

[30] Foreign Application Priority Data

Jul. 29, 1980 [DE] Fed. Rep. of Germany ..... 3028741
May 12, 1981 [EP] European Pat. Off. ..... 81 103 648.2

[51] Int. Cl.[3] ..... E01C 7/35

[52] U.S. Cl. ..... 404/75; 404/118; 404/101

[58] Field of Search ..... 404/75, 90, 72, 91, 404/101, 118

[56] References Cited

U.S. PATENT DOCUMENTS

| | | | |
|---|---|---|---|
| 3,604 | 5/1844 | Sutton | 404/118 X |
| 727,512 | 5/1903 | Warren | 404/75 |
| 1,227,926 | 5/1917 | Parker | 404/118 X |
| 1,371,839 | 3/1921 | Bartell | 404/118 X |
| 1,512,125 | 10/1924 | Mende | 404/75 X |
| 1,670,346 | 5/1928 | Finley | 404/75 |
| 1,833,878 | 11/1931 | Adams | 404/118 X |
| 1,941,833 | 1/1934 | Gustafson | 404/118 X |
| 2,039,026 | 4/1936 | Pease | 404/75 |
| 2,169,987 | 8/1939 | Mosel | 404/75 |
| 4,195,946 | 4/1980 | Sevistler | 404/75 |

*Primary Examiner*—Nile C. Byers, Jr.
*Attorney, Agent, or Firm*—Shapiro and Shapiro

[57] ABSTRACT

For filling tracks worn in roadways, roadmaking material, preferably asphalt, is simultaneously laid in two adjacent tracks and in the intermediate strip of roadway, for which purpose the old material of the marginal regions of the tracks is replasticized as well as that of the intermediate strip; should the old surface of the intermediate strip be higher than the outer marginal regions of the two tracks, the replasticized material of the intermediate strip is removed to approximately the same level as the outer marginal regions of the two tracks, the removed material is laid in the tracks and, finally, the exposed surface of the intermediate strip is roughened before the new material is laid. Two stripping-laying apparatuses which are arranged at a distance from one another laterally of the working direction serve to fill the tracks and are connected together by a stripping element whose lower stripping edge is level with the front ends of the lower stripping edges of the stripping-layer apparatuses. Should the surface of the strip of roadway between two adjacent tracks be higher than the outer marginal regions of these two tracks, levelling and roughening devices for the strip of roadway lying between the two tracks are arranged in the working direction in front of the laying apparatuses connected by the stripping element.

14 Claims, 9 Drawing Figures

METHOD AND DEVICE FOR LAYING ROADMAKING MATERIAL IN A ROADWAY

FIELD OF THE INVENTION

The invention relates to a method for resurfacing roadways in which tracks have been worm with roadmaking material, preferably asphalt, wherein old surfacing material of the marginal regions of the tracks is replasticized by heating.

BACKGROUND OF THE INVENTION

A method of this kind has been described. Only the actual tracks are refilled in this known method, whereas the roadway strip lying between two neighbouring tracks is not renewed (German Specification No. is DE-A-25 24 762).

The invention also relates to a device for carrying out the method. In this connection an apparatus is known which comprises two stripping-laying apparatus graders which are arranged at a distance from one another laterally of the working direction and serve to fill two adjacent tracks. The strip of roadway lying between the graders is not therefore covered by this apparatus as well, as a result of which this intermediate strip remains at the original, low road level as compared with the inner edges of the asphalt strips filling the tracks.

According to this prior art, pools of water, which may give rise to accidents, are often formed between the two inner edges of the track-filling material, laid in strips, as a result of rain or melted snow. Road users are also presented with a disturbing optical effect, caused by the two separate asphalt tracks.

OBJECT OF THE INVENTION

An object of the invention is to provide a method and a device with which the formation of a difference in level between the filled tracks and the intermediate strip of roadway can be avoided by simple means.

SUMMARY OF THE INVENTION

The present invention provides a method in which roadmaking material is simultaneously laid in two adjacent tracks and in the intermediate strip, for which purpose the old material of the marginal regions of the tracks is replasticized as well as that of the intermediate strip and, should the old surface of the intermediate strip be higher than the outer marginal regions of the two tracks, the re-plasticized material of the intermediate strip is removed to at least the same level as the outer marginal regions of the two tracks, the removed material is laid in the tracks and, finally, the uncovered surface of the intermediate strip is roughened before the new material is laid.

The method according to invention enables the above-mentioned disadvantages of the prior art to be avoided and a solid and plane top layer of uniform appearance to be provided by using a construction method which is extremely economical as regards material.

The material-saving and therefore inexpensive laying method results from two reasons. Firstly, the new material is applied as thinly as possible to the intermediate strip between two adjacent tracks, without any impairmant of the quality of the surface. Secondly, should the old surface of the intermediate strip be higher than the outer marginal regions of the two tracks, the material which has been removed is reused, thus reducing the required quantity of new material.

The device according to the invention for carrying out the claimed method is characterised in that a central grading section or stripping element is arranged between a pair of outer grading sections or stripping-laying apparatuses and is connected to the stripping-laying apparatuses such that the lower stripping edge of the stripping element and the front ends of the lower stripping edges of the stripping-laying apparatuses are disposed at the same level. The stripping element is connected to the adjacent stripping laying apparatuses such that resurfacing material laid on the intermediate strip is provided with a flat surface while material laid in each track is provided with a domed surface above the level of said flat surface.

Stripping-laying apparatus of the above-mentioned type is known from German Specification No. DE-B-24 58 266.

In order to prevent the asphalt, which is always pushed in front of the apparatus according to the invention as surplus, from accumulating to such an extent as to give rise to a considerable pressure on the system consisting of the two stripping-laying apparatuses and the stripping element according to the invention so as to prevent the material being laid satisfactorily, the stripping element is preferably of angular construction and preferably mounted with the apex of this angle pointing to the front.

A further advantageous embodiment of the subject matter of the invention is provided in that the stripping element is connected to inner stripping plates of the adjacent stripping-laying apparatuses such that the lower stripping edges of the inner stripping plates of the adjacent stripping-laying apparatuses are inclined with respect to the lower stripping edge of the stripping element which is guided parallel to the surface of the road. It is thus possible to increase, as required, the thickness of the asphalt which is laid in the centre, and thus the deepest part, of the track, without the thickness being altered in an undesirable manner in the region of the stripping element.

In accordance with a further advantageous embodiment of the invention, the stripping element can consist of two stripping surfaces which are hinged to each other and to the inner edges of the adjacent inner stripping plates of the stripping laying apparatuses which only fill the tracks and the apex formed by the two stripping plates can be directed both in and against the laying direction. A continuously variable adaptation to the different widths of the interspaces resulting from the varying dimensions of the tracks is thus possible.

Should the old surface of the strip of roadway lying between two adjacent, i.e. associated, tracks, be higher than the outer marginal regions of these two tracks, levelling and roughening devices may be arranged in the working direction in front of the laying apparatuses connected by the stripping element.

By means of these devices the asphalt, which has been replasticized in a previous working step, of a cambered intermediate strip between two adjacent tracks is removed to a predetermined level, this removed material is laid in the two tracks and, finally, the exposed surface of the intermediate strip is roughened. The intermediate strip is therefore ready for new material to be laid and the roughening operation simultaneously provides the requirement for good bonding between the applied asphalt filler and the old road surface.

Bulges in the asphalt, which frequently occur between the tracks in asphalt roads, for example, were removed in previous methods by cutters, rotating worms or steel rakes acting at right angles to the axis of the road. However, these methods cannot easily be combined with an asphalt construction, in which either the individual tracks alone are to be filled in a technically perfect manner, and thus without any subsequent secondary compression phenomena, or the levelled strip between two tracks or between two pairs of tracks is to become an acceptable section of the new road surface. In the case of this asphalt construction the entire strip between the outermost edges of a pair of tracks should be plane and covered with fresh asphalt in the camber provided so that the asphalt can be laid with a domed profile in order to exclude subsequent secondary compressions, which are the beginning of new track formations. In this connection reference is again made to the above-mentioned Specification No. DE-B-24 48 266.

The claimed device also enables the entire region of a roadway surface between the outermost edges of a pair of tracks to be covered with asphalt such that, following the completion of the surface reconstruction work, including the secondary compression caused by the traffic, a plane surface covering of uniform appearance results, when the asphalt between two tracks or two pairs of tracks has cambered to above the required level and therefore it is not easily possible to coat this roadway strip as well.

A particularly simple levelling device is formed by an angular levelling element whose apex points in the working direction.

The roughening device may be formed by a plurality of roughening spikes arranged in the manner of a rake transverse to the intermediate strip.

Both devices can be combined and constructed in a simple manner by arranging the roughening spikes directly at the corners of the levelling element, the working surfaces of the corners of the levelling element lying in front of the roughening spikes in the working direction.

Embodiments of the invention are explained in the following description with reference to the drawings.

DESCRIPTION OF PREFERRED EMBODIMENTS

As referred to in the "Summary of the Invention", a roadway surface b having spaced tracks S' and an intermediate strip Z' between the tracks is resurfaced by first re-plasticizing the existing surfacing material at the marginal regions of the tracks and in the intermediate strip by heating, then laying new surfacing material on the roadway and grading this with apparatus in accordance with the invention, as will be described.

FIGS. 1A, 1C, 2A and 2C show the method of operation of apparatus according to the invention. As illustrated, a stripping element, or central grading section of the apparatus, 1 is attached to two stripping-laying apparatuses (outer grading sections) 3, which fill the tracks and are pulled in the working direction A by a tractor which is not shown, the said stripping element distributing the road surfacing material applied to the roadway surface b by a tractor or another means such that it evenly fills the interspace e, which is not covered by the two adjacent stripping-laying apparatuses 3, at the level c of the asphalt layers bordering on both sides. The fill thickness f, which usually varies and is dependent upon the depths of the tracks and the easiness with which the filling material a to be applied compresses, is adjusted by adjusting devices 9, 10 and 11. A new, uniform and plane roadway surface i is produced between the two edges g following compression of the filling material a by rollers and traffic (FIG. 2D).

Figures 1A, 1B, 1C, 2A, 2B, 2C, 2D:
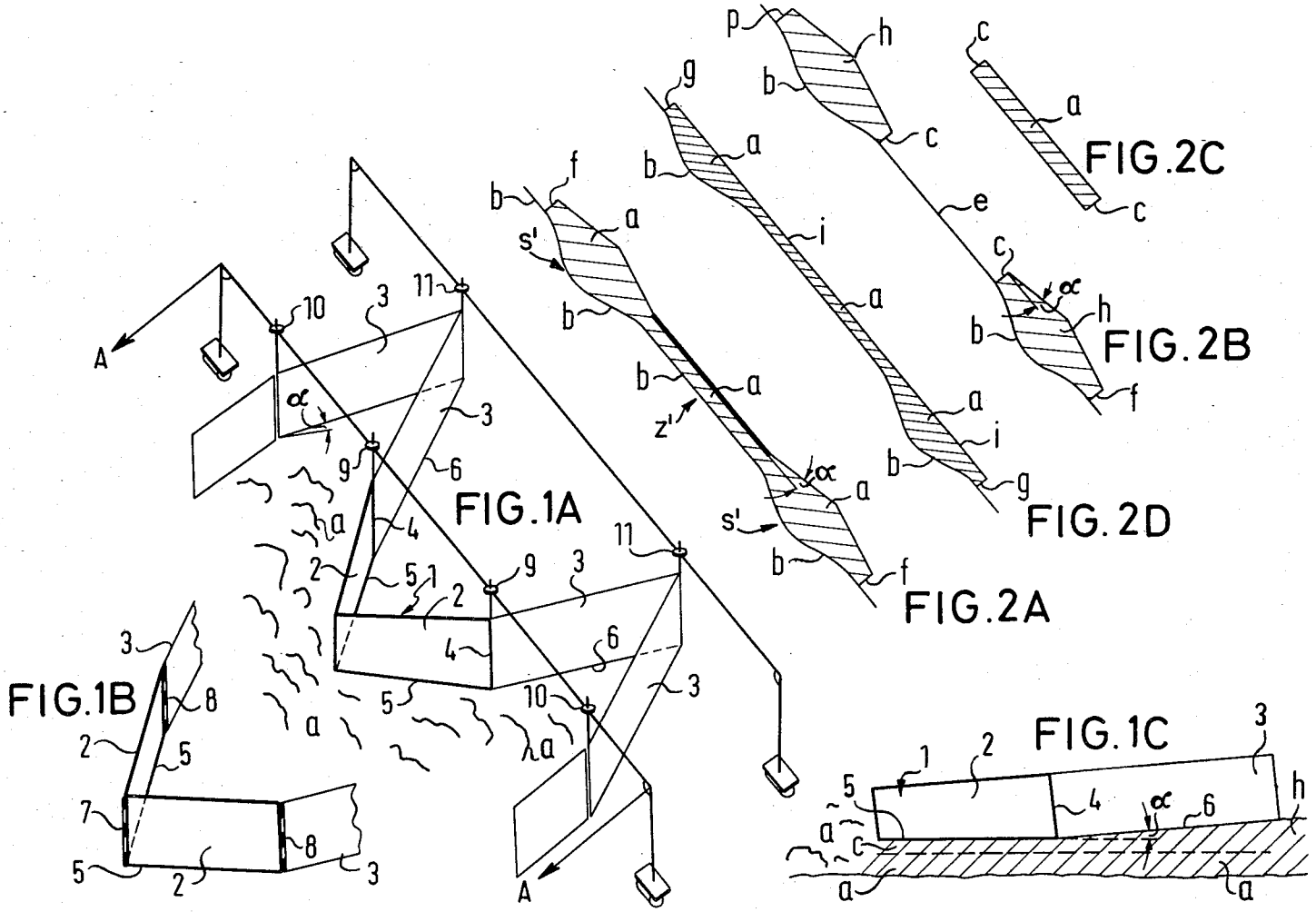
FIG. 1A is a schematic, perspective view of apparatus in accordance with the invention comprising a stripping element arranged obliquely with respect to a working direction between two adjacent stripping-laying apparatuses.
FIG. 1B is a schematic, perspective view of an alternative construction of a part of the apparatus according to the invention.
FIG. 1C is a sectional view of the roadway surface and a side view of one of the stripping plates of the stripping element and one of the stripping-laying apparatuses.
FIG. 2A is a section through asphalt surfacing material as it is applied and granted on a roadway surface in accordance with the invention.
FIG. 2B is a sectional view of the surfacing material as laid and graded by two stripping-laying apparatuses.
FIG. 2C is a section through the surfacing material which has been applied to the intermediate strip of roadway surface and levelled to form a plane surface by the stripping element according to the invention.
FIG. 2D is a section through the surfacing materal of the finished surface coating which has been applied and compressed by the stripping-laying apparatuses and the stripping element according to the invention.

FIG. 1B shows a stripping element, which consists of two stripping plates 2 which are connected together and to the stripping-laying apparatuses 3 by hinged devices 7 and 8 respectively. A stripping element of this kind, arranged in a hinged manner, is able to adapt to each change in distance e between the two stripping-laying apparatuses resulting from varying dimensions of the tracks.

FIG. 1C clearly shows that the stripping edge 5 of the stripping element 1 lies in a horizontal plane and gives rise to a roadway surface according to FIG. 2A. The stripping edge 6 of the stripping plate 3 of the stripping-laying apparatus extends upwards at an angle from the rear edge of the stripping edge 5 of the stripping plate 2 of the stripping element 1 and gives rise to a domed surface profile h over the tracks corresponding to FIG. 2A.

Figure 3A:
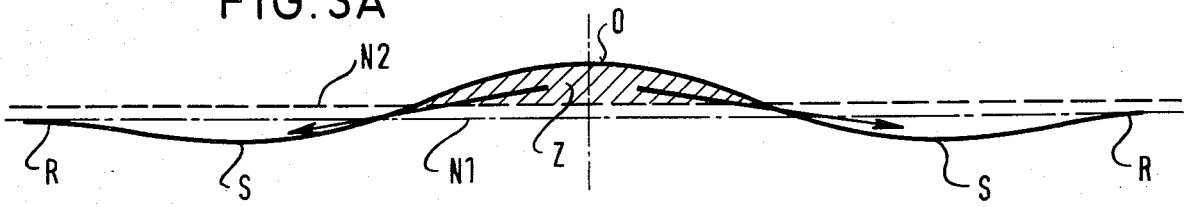
FIG. 3A is a section through a roadway surface, in which an intermediate roadway strip lying between two tracks is higher than the outermost marginal regions of the two tracks.

FIG. 3A is a schematic section through a roadway surface, in which the surface O of the roadway strip Z lying between two adjacent tracks S is higher than the outer marginal regions R of the two tracks S.

In order to cover the intermediate strip Z so as to make it flush with the tracks, it is necessary, in these circumstances, to replasticize the old, excess material of the intermediate strip Z and subsequently to bring it down to the same level N1 as the outer marginal regions R of the two tracks S. In this respect it is of great advantage to immediately fill the tracks S with the material which has been removed, as the necessary quantity of new material is thereby reduced and the cost of the reconstruction operation can be considerably decreased. Following the removal of the excess material, the exposed surface of the intermediate strip Z is roughened, so as to make provision for the bonding of the new material which has been applied with the old surface. The new material is simultaneously laid both in the tracks S and in the intermediate strip Z, as previously described, thus producing a new, uniform and plane roadway surface corresponding to level N2.

Figure 3B:
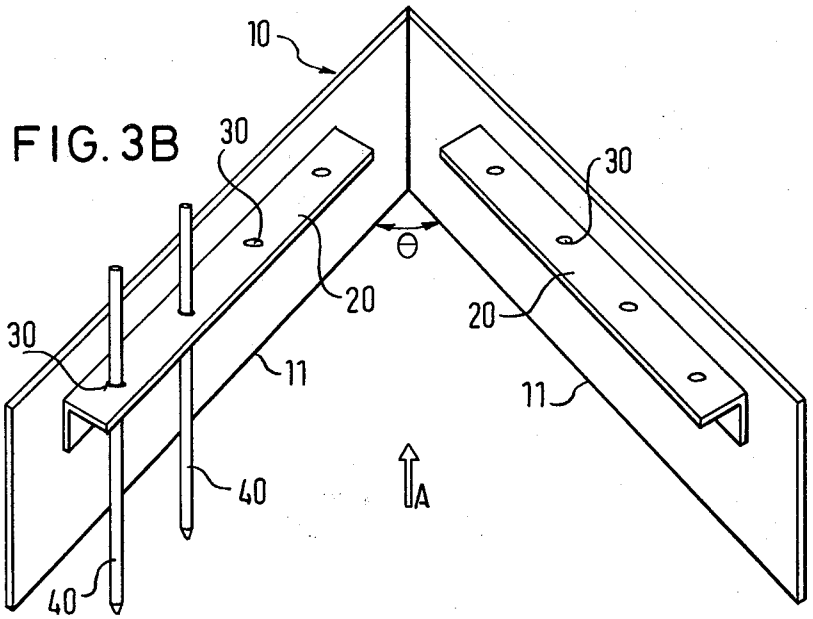
FIG. 3B is a schematic representation of levelling and roughening devices for the intermediate strip.

FIG. 3B is a schematic representation of devices adapted for the above-mentioned operations. They include an angular levelling element, designated as a whole by 10, with lower levelling edges 11, which are adjusted to the level N1 which is to be reached in the region of the intermediate strip Z. For this purpose the levelling element 10 is accordingly adjustably arranged, for example on a pushing machine. The angle $\theta$ between the two arms of the angular levelling element is also variable, so that it can be adapted to the respective width of the intermediate strip Z. The apex of the angular levelling element 10 points in the working direction A during the movement of the levelling element in the working direction A over the intermediate strip Z, as a result of which the previously re-plasticized, excess material of the intermediate strip Z, which has been removed by this movement, is proportionately pushed into the two adjacent tracks S.

A roughening device is also provided which comprises a plurality of roughening spikes 40 arranged in the manner of a rake transverse to the intermediate strip Z. In order to simplify this construction, angle irons 40, extending parallel to the levelling edge 11, are mounted on the rear faces, with respect to the working direction A, of the two arms of the levelling element 10 and are provided at regular intervals with mountings 30, in which the roughening spikes 40 are mounted in essentially vertical alignment so as to be adjustable in height.

The levelling element 10 with the roughening spikes 40 is arranged in the working direction in front of the stripping-laying apparatuses 3 connected by the stripping element 1. The two subassemblies can be disposed on separate transporting or pushing machines or on a common transporting machine.

We claim:

1. A method of resurfacing a roadway already surfaced with existing asphalt or like surfacing material and in which spaced tracks have been formed, the method comprising re-plasticizing the existing material of marginal regions of the tracks and of an intermediate strip therebetween, laying new surfacing material on the roadway so as to fill the tracks and cover the intermediate strip, grading the new material to a profile having a substantially flat section over the intermediate strip and domed sections over the tracks extending above the level of said flat section, then compressing the new material to provide a substantially flat surface across the entire extent of both the tracks and the intermediate strip.

2. A method as claimed in claim 1, wherein prior to resurfacing, the level of the intermediate strip is above the level of the outer marginal regions of the tracks, the method including the additional steps prior to the laying of the new surfacing material on the roadway of removing the re-plasticized material of the intermediate strip to substantially the level of said outer marginal regions, and laying the material thus removed in the tracks.

3. A method as claimed in claim 2 including roughening the intermediate strip after removing the replasticized material and before laying the new material.

4. Apparatus for grading surfacing material laid on a roadway having spaced tracks and an intermediate strip between the tracks, the apparatus being adapted to be moved over the roadway in a working direction and comprising a central grading section with means for providing the surfacing material with a substantially flat surface over the intermediate strip, and outer grading sections extending from opposite ends of the central section substantially without a break therebetween, the outer grading sections each having means for providing the surfacing material with a domed surface over one of the tracks, the domed surfaces extending from opposite ends of said flat surface to a level above the level of the flat surface.

5. Apparatus as defined in claim 4, wherein the central grading section comprises two parts disposed at an angle to one another.

6. Apparatus as defined in claim 5, wherein the angle points in the working direction of the apparatus.

7. Apparatus as defined in claim 5, wherein the two parts are hinged together to define said angle.

8. Apparatus as defined in claim 7, wherein outer edges of the central grading section are hinged to inner edges of the respective outer grading sections.

9. Apparatus as defined in claim 8, wherein each of the outer grading sections comprises two parts disposed at an angle to one another.

10. Apparatus as defined in claim 9, wherein the last-mentioned angle points in a direction opposite to the working direction of the apparatus.

11. Apparatus as defined in claim 4 in combination with levelling means and roughening means for the intermediate strip disposed forwardly of the apparatus in the working direction thereof.

12. Apparatus as defined in claim 11, wherein the levelling means comprises an angular levelling element with arms defining an apex pointing in the working direction of the apparatus.

13. Apparatus as defined in claim 12, wherein the roughening means is disposed behind the levelling means and comprises a plurality of spikes arranged to provide a raking action across the width of the intermediate strip.

14. Apparatus as defined in claim 13, wherein the spikes are carried on the arms of the levelling element.

* * * * *